US005697584A

United States Patent [19]

Chew

[11] Patent Number: 5,697,584

[45] Date of Patent: Dec. 16, 1997

[54] RAILROAD SEARCHLIGHT SIGNAL WITH SOLID STATE ILLUMINANT AND ASPECT INDICATION

[75] Inventor: James P. Chew, Jeannette, Pa.

[73] Assignee: Union Switch & Signal Inc., Pittsburgh, Pa.

[21] Appl. No.: 644,597

[22] Filed: May 13, 1996

Related U.S. Application Data

[60] Provisional application No. 60/001,548 Jul. 27, 1995.

[51] Int. Cl. [6] ..... B61L 9/00

[52] U.S. Cl. ..... 246/473.3; 340/815.45; 340/815.65

[58] Field of Search ..... 246/473, 473.3, 246/479, 484, 1 C; 340/815.45, 815.66, 815.65

[56] References Cited

U.S. PATENT DOCUMENTS

| | | | |
|---|---|---|---|
| 2,503,786 | 4/1950 | Wells | 246/484 |
| 2,520,445 | 8/1950 | Sponsler | 246/484 |
| 3,576,563 | 4/1971 | Scott | 246/473.3 |
| 4,283,716 | 8/1981 | Pasquali | 246/473.3 |
| 4,700,278 | 10/1987 | Chew | 246/473.3 |
| 4,754,272 | 6/1988 | Illenberg et al. | 246/473.3 |

FOREIGN PATENT DOCUMENTS

| | | | |
|---|---|---|---|
| 2639683 | 6/1990 | France | 246/473.3 |

OTHER PUBLICATIONS

Specification sheet for Rainbow (RGB) LED packages, Ledtronics, Inc., 400 Pacific Coast Highway Torrance, CA 90505, (no date).

*Primary Examiner*—Mark T. Le

*Attorney, Agent, or Firm*—Kevin A. Sembrat

[57] ABSTRACT

A railroad searchlight signal for producing light signals of selected colors. The searchlight uses a reflector that has an inner surface of reflective material and a focal point. One or more light emitting diodes are provided at the reflector focal point. When a current is supplied to the light emitting diode from a variable current power source, a light having a color that varies dependent upon the current is produced. The colored light produced at the light emitting diode is then directed outward of the reflector as a beam. At least one color filter that allows light of a respective color to pass therethrough is preferably provided proximate the reflector. Light that passes through the color filter is detected by a light detector such as a photovoltaic cell, a phototransistor or a photodiode.

16 Claims, 4 Drawing Sheets

| | | | ABSOLUTE MAX RATINGS TO=25°C | | | | ELECTRO-OPTICAL CHARACTERISTICS TO=25°C | | | | | |
|---|---|---|---|---|---|---|---|---|---|---|---|---|
| LEDTRONICS (TORRANCE, CA, USA) PART NO. | LENS COLOR | L.E.D. RADIATION COLOR | Pd mW | Ifp mA | If mA | Vr V | If typ mA | Iv typ med | Vf typ/max | VIEW ANGLE | Ir MAX μA | Σ P nm |
| DIS-1024-002 | CLEAR | RED | 100 | 100 | 30 | 5 | 20 | 30 | 2.0/2.8 | 34 | 100 | 625 |
| | | GREEN | 100 | 100 | 30 | 5 | 20 | 50 | 2.1/2.8 | 34 | 100 | 567 |
| | | BLUE | 200 | 300 | 80 | 5 | 60 | 10 | 2.8/3.5 | 34 | 100 | 470 |
| DIS-1024-102 | DIFFUSED | RED | 100 | 100 | 30 | 5 | 20 | 23 | 2.0/2.8 | 60 | 100 | 625 |
| | | GREEN | 100 | 100 | 30 | 5 | 20 | 34 | 2.1/2.8 | 60 | 100 | 567 |
| | | BLUE | 200 | 300 | 80 | 5 | 60 | 6 | 2.8/3.5 | 60 | 100 | 470 |
| DIS-1024-103 | CLEAR | U. RED | 100 | 200 | 40 | 4 | 20 | 120 | 1.7/2.4 | 34 | 100 | 660 |
| | | P. GRN. | 125 | 100 | 50 | 4 | 20 | 12 | 2.2/2.6 | 34 | 100 | 558 |
| | | BLUE | 200 | 300 | 80 | 5 | 60 | 10 | 2.8/3.5 | 34 | 100 | 470 |
| DIS-1024-102 | DIFFUSED | U. RED | 100 | 200 | 40 | 4 | 20 | 75 | 1.7/2.4 | 60 | 100 | 660 |
| | | P. GRN. | 125 | 100 | 50 | 4 | 20 | 9 | 2.2/2.6 | 60 | 100 | 558 |
| | | BLUE | 200 | 300 | 80 | 5 | 60 | 6 | 2.8/3.5 | 60 | 100 | 470 |
| DIS-1024-004 | CLEAR | RED | 100 | 100 | 30 | 5 | 20 | 30 | 2.0/2.8 | 34 | 100 | 625 |
| | | P. GRN. | 125 | 100 | 50 | 4 | 20 | 12 | 2.2/2.6 | 34 | 100 | 558 |
| | | BLUE | 200 | 300 | 80 | 5 | 60 | 10 | 2.8/3.5 | 34 | 100 | 470 |
| DIS-1024-104 | DIFFUSED | RED | 100 | 100 | 30 | 5 | 20 | 23 | 2.0/2.8 | 60 | 100 | 625 |
| | | P. GRN. | 100 | 100 | 50 | 4 | 20 | 9 | 2.2/2.6 | 60 | 100 | 558 |
| | | BLUE | 200 | 300 | 80 | 5 | 60 | 6 | 2.8/3.5 | 60 | 100 | 470 |

(PRIOR ART)

Fig. 6

RAILROAD SEARCHLIGHT SIGNAL WITH SOLID STATE ILLUMINANT AND ASPECT INDICATION

CROSS-REFERENCE TO RELATED APPLICATION

This application claims the benefit of U.S. Provisional Application No. 60/001,548, filed Jul. 27, 1995, which is hereby incorporated by reference in its entirety.

BACKGROUND OF THE INVENTION

1. Field of the Invention

This invention relates generally to the railroad industry and more particularly to searchlight signals used along railways.

2. Description of the Related Art

Searchlight signals are currently used in the railroad industry to provide information to railway vehicles through the displaying of colored light signals which are, generally, red, yellow and green. An example of a prior art searchlight signal is depicted in prior art FIG. 1.

Existing searchlight signals such as the type shown in FIG. 1, are generally comprised of an incandescent lamp, a reflector and several colored filters. The incandescent lamp is a source of illumination and is provided within a focal point of the reflector. The elliptical reflector produces a beam of concentrated light from the incandescent lamp and directs that beam of concentrated light outward of the reflector. The colored filters impart a color to the beam of light.

The colored filters of the searchlight signal are provided within a unit called a spectacle that is shown individually in prior art FIG. 2. The spectacle is rotationally mounted in front of the reflector and lamp. The spectacle is electrically connected such that depending upon the polarity of the electrical energy applied to the spectacle, the filter having the desired color will be rotated into the proper position in front of the reflector and lamp. Thus, if energy of a certain polarity is fed to the searchlight signal, a yellow filter will be rotated into position in the path of the beam and a yellow light will be directed from the searchlight signal. If the polarity is then reversed, the spectacle will again rotate such that the green filter will be positioned in the path of the beam and a green light will be directed from the searchlight signal. When the searchlight signal is de-energized, the red filter is positioned, typically through gravity, in the path of the light beam and a red light will be directed from the searchlight signal.

Electrical contacts are also incorporated into the searchlight signal. When the spectacle is rotated into one of its three positions, the electrical contacts are made and a positive indication of the searchlight signal aspect (i.e., the position of the spectacle and, therefore, which filter is positioned in the path of the light beam) may be furnished to the rest of the signal system.

The rotatable searchlight signals of the prior art have the advantages of efficiency and long range. However, the prior art searchlight signal utilizes moving parts and thus is susceptible to failure. Moreover, the moving parts of the prior art searchlight signal cause it to be more costly to manufacture than other types of signals.

Thus, it would be advantageous to develop a searchlight signal that did not require moving parts for its operation, but that provides an adequate and dependable light signal.

SUMMARY OF THE INVENTION

The present invention provides a railroad searchlight signal for producing light signals of selected colors, which signal utilizes a light emitting diode illuminant in cooperation with a reflector.

An advantage of the present invention is that the present searchlight signal utilizes no moving parts and can therefor be manufactured at relatively low cost and will be more reliable as compared to searchlight signals previously known in the industry which utilize a rotatable spectacle.

Another advantage of the present invention is that use of a light emitting diode minimizes the necessity of frequent incandescent lamp changes.

Another advantage of the present invention is that the aspect displayed is reported to the rest of the signal system, thereby enabling the present invention to replace existing searchlight mechanisms.

Briefly described, the railroad searchlight signal of the present invention has a reflector that is shaped generally as a truncated ellipse so as to have a rounded first end. The reflector also has an inner surface that is made of or is coated with reflective material and has circular openings at its first and second ends. Further, the reflector is shaped so as to have a focal point, in which light that is present at the focal point is directed outwardly from the reflector as a beam.

One or more light emitting diodes are then positioned at the reflector focal point. The light emitting diode is the type in which light is produced in response to electrical power, and the color produced by the light emitting diode varies depending upon the current applied to the various electrical connections of the light emitting diodes.

A variable-current power source is connected to the light emitting diode so that when the light emitting diode is energized, light having selected colors is produced from the light emitting diode. The power source is generally a low voltage direct-current source with suitable resistors to properly limit the current. The light produced by the light emitting diode is then directed outward of the reflector as a beam.

In order to verify the color of the light which is being transmitted by the searchlight signal, the searchlight signal further preferably utilizes one or more color filters provided proximate the second end of the reflector. Each color filter allows light of a particular color to pass therethrough. The color filters are chosen to correspond to the colors which are desired to be produced by the searchlight signal. For example, it is preferred that the searchlight signal produce red, green and yellow light, thus the searchlight signal also utilizes red, green and yellow color filters.

A light detection means is connected to or is provided in series with the color filters. Thus, light that passes through the color filter is detected by the light detection means. Any means for detecting light may be utilized, however, the preferred light detection means are either one or more photovoltaic cells, phototransistors or photodiodes. The searchlight signal further preferably includes means for generating a signal when the light detection means detects light.

Other objects and advantages of the invention will become apparent from a description of certain present preferred embodiments thereof shown in the drawings.

BRIEF DESCRIPTION OF THE DRAWINGS

FIG. 6 is a portion of a chart from a prior art specification sheet for various light emitting diode packages.

DETAILED DESCRIPTION OF THE PREFERRED EMBODIMENTS

Figure 2:
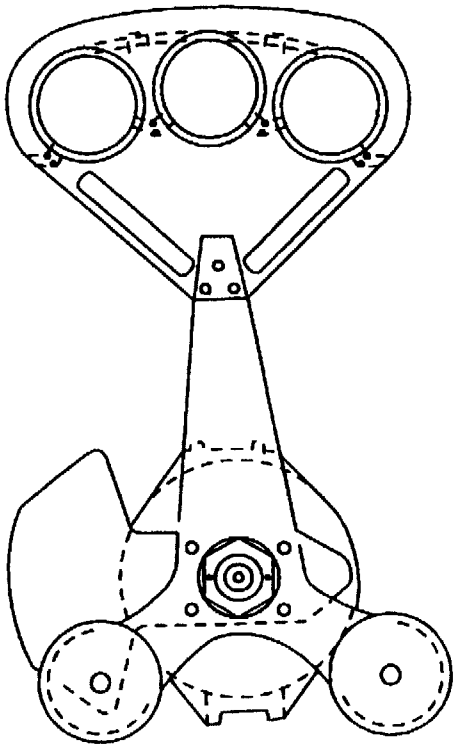
(PRIOR ART) Fig. 2
FIG. 2 is a front elevational view of a prior art spectacle.
Figure 1:
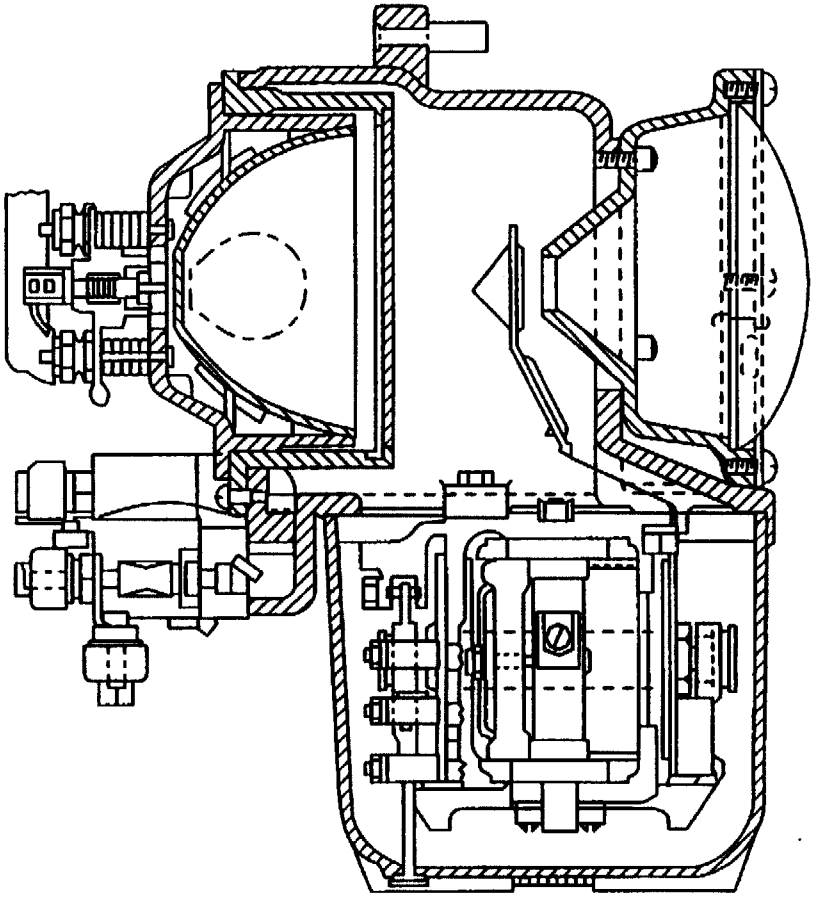
(PRIOR ART) Fig. 1
FIG. 1 is a view taken in cross section of a prior art searchlight signal.
Figure 3:
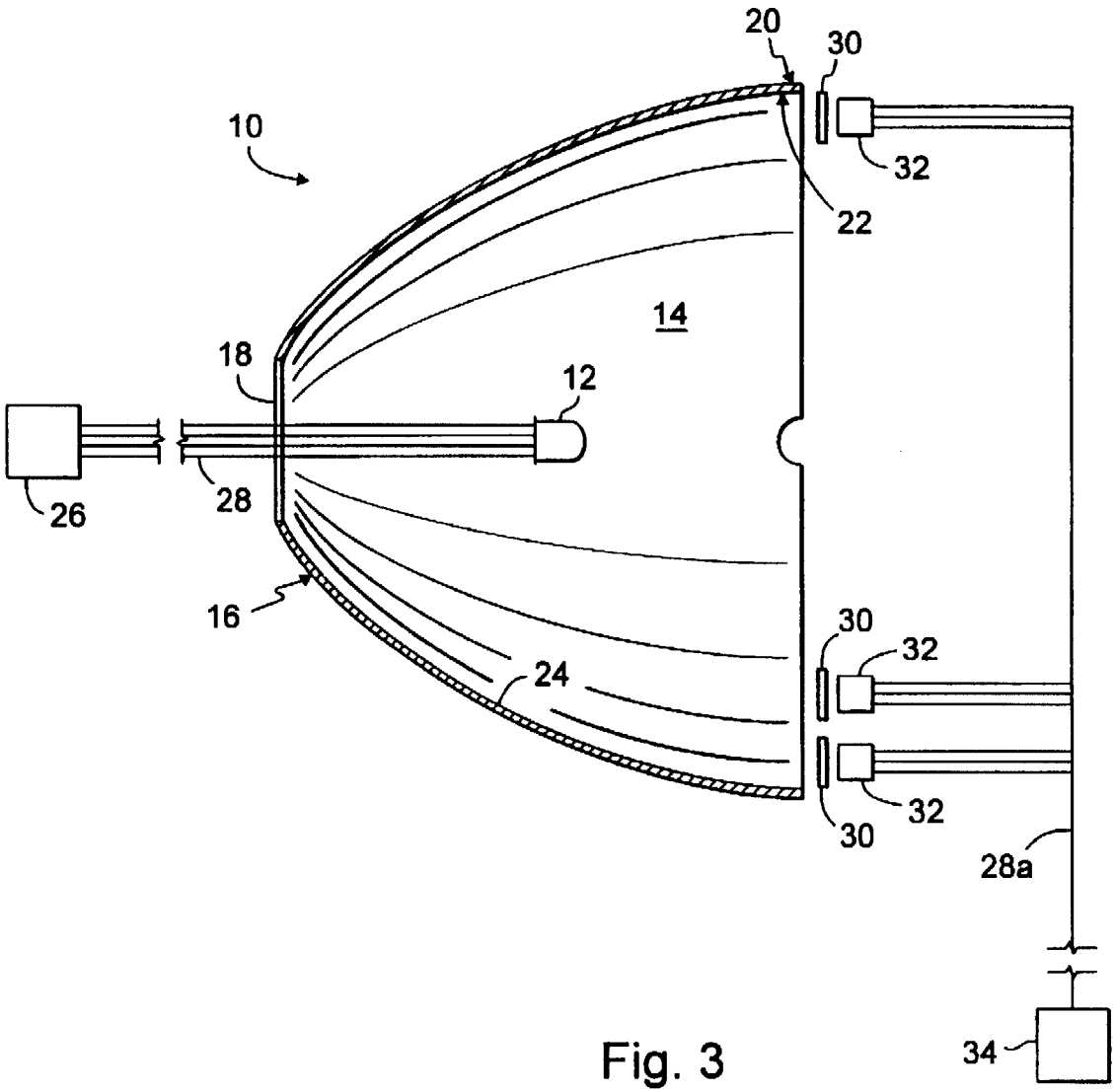
FIG. 3 is a schematic representation of a portion of the preferred searchlight signal.
Figure 5:
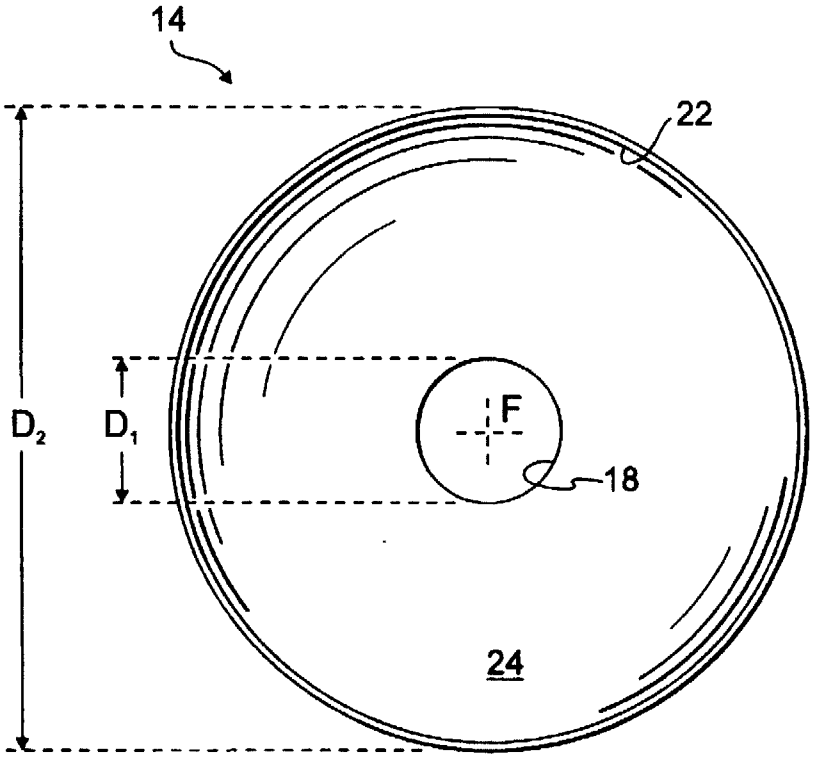
FIG. 5 is a front elevational view of the preferred reflector for use in the searchlight signal.
Figure 4:
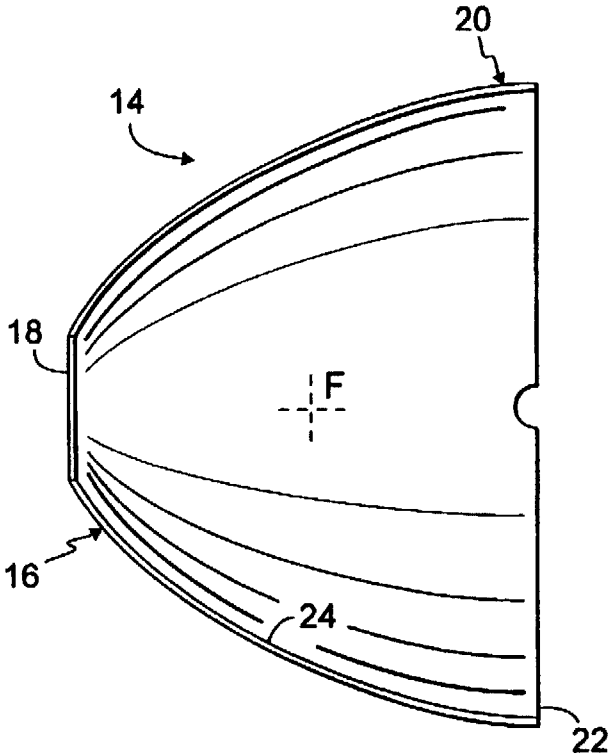
FIG. 4 is a side elevational view taken in cross section of a preferred reflector for use in the searchlight signal.

Referring to FIGS. 3, 4 and 5, a portion of a railroad searchlight signal 10 is shown for producing light signals of selected colors. In particular, those portions of searchlight signal 10 that produce light, reflect the light and indicate the aspect of the searchlight signal 10 are shown.

The presently described searchlight signal 10 utilizes a light emitting diode illuminant 12 in cooperation with a reflector 14. The railroad searchlight signal reflector 14 is shaped generally as a truncated ellipse so as to have a rounded first end 16 and a circular opening 22 at a second end 20. The reflector 14 also has a circular opening 18 at the first end 16. The circular opening 18 at the first end 16 of the reflector 14 has a diameter that is labeled as $D_1$ in FIG. 5. The circular opening 22 at the second end 20 of the reflector 14 also has a diameter that is labeled as $D_2$ in FIG. 5. Diameters $D_1$ and $D_2$ are chosen so that diameter $D_1$, of the first end opening 18 is less than the diameter D2 of the second end opening 22.

The reflector 14 is preferably made of nickel, however, other suitable materials such as glass may be used. The reflector has an inner surface 24 that is made of or is coated with one or more reflective materials. In this way, the inner surface 24 of the reflector is capable of reflecting light well. Although any suitable reflective material may be used, a surface coating of rhodium is preferred, in conjunction with a nickel reflector.

As is generally known in the industry, reflectors are shaped so as to have a focal point (indicated in dotted line as F in FIGS. 4 and 5). The focal point of a reflector is that point or position in which reflection is maximized for light that is present at that position within the reflector, by being reflected from the many reflection points along the inner, reflective surface of the reflector and directed outward from the reflector as a beam. The nickel reflector is more durable that the glass reflectors of the prior art. Nickel reflectors may be consistently manufactured to closer tolerances more readily than the glass reflectors; this makes focusing of signals much easier.

The present preferred searchlight signal 10 further has one or more light emitting diodes 12 positioned at the reflector focal point F. The light eluminating diode 12 is the type in which light is produced in response to electrical power. Furthermore, the light emitting diode 12 is equipped with a multiplicity of semiconductor junctions of different colors, each having its own lead wires. By energizing suitable combinations of these leads, selected junctions will emit light. The light from the various junctions will mix together, to yield the desired output color. Therefore, by controlling the current through the various lead wires, the color of light emitted by the light emitting diode 12 may be controlled. In other words, controlling the current through the lead wires controls the mixing of colors from the semiconductor junctions within the light emitting diode. Light emitting diodes of the type described here are commonly referred to as "Rainbow" LEDs in the electro-optical industry.

A variable-current power source 26 is then connected to the light emitting diode 12 through electrical wiring 28. Thus, when the light emitting diode 12 is energized by selected currents through selected electrical wiring 28, light having colors corresponding to those currents is produced from the light emitting diode 12. Light produced by the light emitting diode 12 is directed outward of the reflector 14 as a beam through the circular opening 22 at the second end 20 of the reflector 14.

The package of the light emitting diodes 12 is chosen so that as different combinations of polarities and voltages are applied to leads of the electrical wiring 28 connected to the light emitting diodes 12, different colors are produced. Thus, a selected color or colors may be obtained through the selection of particular voltages and polarities. The light emitting diode(s) 12 is incorporated in the reflector 14 that is generally similar to reflectors used in prior an searchlight signals. The preferred light emitting diode 12 package utilized in the present searchlight signal 10 is preferably manufactured by Ledtronics, Inc. as model DIS-1024-002 for instance. Some light emitting diode package data for various Ledtronics parts is shown in the chart of FIG. 6, taken from a specification sheet for various Ledtronics "rainbow" package LEDs, which specification sheet is incorporated by reference herein in its entirety.

In order to verify the color of the light which is being transmitted by the searchlight signal 10, the searchlight signal 10 further preferably utilizes one or more color filters 30 provided proximate the second end 20 of the reflector 14. Each color filter 30 allows light of a particular color to pass therethrough. The color filters 30 are chosen to correspond to the colors which are desired to be produced by the searchlight signal 10. For example, it is preferred that the searchlight signal 10 produce red, green and yellow light, thus the searchlight signal also utilizes red, green and yellow color filters.

Light detection means 32 is connected to or is provided in series with the color filters 30. Thus, light that passes through any of the color filters 30 is detected by the light detection means 32. Any means 32 for detecting light may be utilized, however, the preferred light detection means 32 are either one or more photovoltaic cells, phototransistors or photodiodes. If photovoltaic cells are utilized, they will generate voltages when receiving light through the filters 30. Phototransistors or photodiodes will conduct current upon receiving light through the filters 30.

The searchlight signal 10 further preferably includes signal generating means 34 for generating a signal when the light detection means 32 detects light. Generally, signal generating means 34 will respond to the voltages generated by or the current passed by light detection means 32 through electrical wiring 28*a*, and send out a suitable electrical signal to the remainder of the railway signaling system.

In operation, the light emitting diode illuminant 12, when energized by currents of a selected value applied to the electrical wiring 28, will emit light of a color that corresponds to those currents. The reflector 14 will then reflect this light to the lenses (not shown) of the searchlight signal 10, as in a conventional searchlight. Each of the color filters 30 will correspond to one of the colors that is desired as an aspect of this signal. When the desired color of light is emitted by the light emitting diode illuminant 12, it will pass through its corresponding filter 30.

One or more light detection means 32, such as photocells or phototransistors, are also utilized in cooperation with the color filters 30. Thus, when the correct color of light is being displayed by the device 10, that selected color will pass through the filter 30 and cause the corresponding light detection means 32 to respond, i.e., cause the photocell to give off a voltage or cause the phototransistor to conduct current. The change in current or voltage through the corresponding light sensitive means 32 will, through signal generating means 34, furnish information regarding the aspect displayed by the signal to the rest of the signaling system. In this way, the function that is performed by repeater contacts and the conventional searchlight operating unit in the prior an may also be obtained in the present invention without the use of moving parts.

While certain present preferred embodiments distinctly under and described, it is distinctly understood that the invention is not limited thereto but may be otherwise embodied within the scope of the following claims.

What is claimed is:

1. A railroad searchlight signal for producing light signals of selected colors, said searchlight signal comprising:

a reflector that is shaped generally as a truncated ellipse so as to have a rounded first end and a circular opening at a second end, said reflector also having a circular opening at said first end wherein said first end circular opening having a diameter less than that of said second end circular opening, said reflector further has an inner surface of reflective material and a focal point;

at least one light emitting diode provided through said reflector first end circular opening and positioned at said reflector focal point, wherein said at least one light emitting diode produces light when a current is supplied thereto, in which said light has a color that varies dependent upon current values; and a variable current power source connected to said at least one light emitting diode, wherein when said at least one light emitting diode is energized by selected current values, light having colors corresponding to said current values is produced from said at least one light emitting diode and is directed outward of said reflector second end circular opening;

at least one color filter provided proximate said reflector second end, wherein each said at least one color filter allowing light of a respective color produced by said at least one light emitting diode to pass therethrough; and a light detection means, wherein light that passes through said color filter is detected by said light detection means.

2. The searchlight signal of claim 1 further comprising means connected to said light detection means for generating a signal when said light detection means detects light.

3. The searchlight signal of claim 1 wherein said light detection means is a photovoltaic cell.

4. The searchlight signal of claim 1 wherein said light detection means is at least one of a phototransistor and a photodiode.

5. The searchlight signal of claim 1 wherein said reflector is made of nickel in which said inner surface is coated with rhodium.

6. A railroad searchlight apparatus for emitting a light signal of one of a plurality of colors, wherein the apparatus comprises:

reflector means for reflecting emitted light;

illuminant means, positioned within said reflector means, for emitting the light signal of one of the plurality of colors to be reflected therefrom said reflector means;

power supply means for energizing said illuminant means, whereby said illuminant means is electrically coupled to said power supply means;

light detection means for detecting the reflected light signal and electrically providing a detection signal;

color filter means for filtering a predetermined color of light signal to be detected by said light detection means, wherein said color filter means is positioned between said reflector means and said light detection means; and electrical signal generating means for generating an electrical identifying signal related to the predetermined color detected through said color filter by said light detection means.

7. The railroad searchlight apparatus of claim 6, wherein said reflector means is geometrically shaped to have a focal point and has an inner surface of reflective material.

8. The railroad searchlight apparatus of claim 7, wherein said illuminant means is positioned at said focal point of said reflector means, thereby to maximize reflection by said reflector means of the light signal emitted from said illuminant means.

9. The railroad searchlight apparatus of claim 8, wherein said illuminant means is at least one light emitting diode that emits light in response to electrical power.

10. The railroad searchlight apparatus of claim 9, wherein said light emitting diode has a plurality of semiconductor junctions of different colors, wherein each junction has individual lead wires, and wherein each junction, when electrically energized, emits colored light.

11. The railroad searchlight apparatus of claim 10, wherein said light emitting diode is a rainbow LED.

12. The railroad searchlight apparatus of claim 6, wherein said power supply means is a variable-current power source.

13. The railroad searchlight apparatus of claim 6, wherein said light detection means is at least one photovoltaic cell that generates voltage according to light detected through said color filter means.

14. The railroad searchlight apparatus of claim 6, wherein said light detection means is at least one phototransistor that conducts electrical current according to light detected through said color filter means.

15. The railroad searchlight apparatus of claim 6, wherein said light detection means is at least one photodiode that conducts electrical current according to light detected through said color filter means.

16. The railroad searchlight apparatus of claim 7, wherein said reflector means is manufactured of nickel in which said inner surface is coated with rhodium.

* * * * *